US009028193B2

(12) United States Patent
Goedken

(10) Patent No.: US 9,028,193 B2
(45) Date of Patent: May 12, 2015

(54) ADAPTER TO EMPTY REAR END LOAD OR SIDE LOAD REFUSE CONTAINERS INTO FORK BORNE INTERMEDIATE CONTAINER

(71) Applicant: Kenneth D. Goedken, Dubuque, IA (US)

(72) Inventor: Kenneth D. Goedken, Dubuque, IA (US)

(73) Assignee: Kann Manufacturing Company, Guttenberg, IA (US)

( * ) Notice: Subject to any disclaimer, the term of this patent is extended or adjusted under 35 U.S.C. 154(b) by 61 days.

(21) Appl. No.: 13/748,740

(22) Filed: Jan. 24, 2013

(65) Prior Publication Data

US 2013/0195590 A1 Aug. 1, 2013

Related U.S. Application Data

(60) Provisional application No. 61/591,633, filed on Jan. 27, 2012.

(51) Int. Cl.

| | |
|---|---|
| ***B65F 9/00*** | (2006.01) |
| ***B65F 3/04*** | (2006.01) |
| *B65F 3/02* | (2006.01) |

(52) U.S. Cl.

CPC . *B65F 9/00* (2013.01); *B65F 3/041* (2013.01); *B65F 2003/023* (2013.01); *B65F 2003/0279* (2013.01); *B65F 2003/0296* (2013.01)

(58) Field of Classification Search

CPC ..... B65F 3/041; B65F 9/00; B65F 2003/023; B65F 2003/0279; B65F 2003/0296

See application file for complete search history.

(56) References Cited

U.S. PATENT DOCUMENTS

| | | | | | |
|---|---|---|---|---|---|
| 3,147,870 | A * | 9/1964 | Urban et al. | 414/345 |
| 3,702,662 | A * | 11/1972 | Davieau | 414/303 |
| 5,308,211 | A * | 5/1994 | Bayne | 414/408 |
| 5,938,394 | A * | 8/1999 | Christenson | 414/408 |
| 6,139,244 | A * | 10/2000 | VanRaden | 414/408 |
| 6,167,795 | B1 * | 1/2001 | Bayne et al. | 91/405 |
| 6,224,317 | B1 * | 5/2001 | Kann et al. | 414/408 |
| 6,491,489 | B1 * | 12/2002 | Stragier | 414/409 |
| 8,092,141 | B2 * | 1/2012 | Curotto et al. | 414/408 |
| 8,496,427 | B2 * | 7/2013 | Curotto et al. | 414/810 |
| 8,534,977 | B2 * | 9/2013 | Rowland et al. | 414/409 |
| 8,550,764 | B2 * | 10/2013 | Rowland et al. | 414/408 |
| 2005/0111942 | A1 * | 5/2005 | Rimsa et al. | 414/408 |
| 2006/0280582 | A1 * | 12/2006 | Kouri | 414/408 |
| 2007/0243050 | A1 * | 10/2007 | Arrez et al. | 414/618 |
| 2009/0306863 | A1 * | 12/2009 | Curotto et al. | 701/50 |
| 2010/0322749 | A1 * | 12/2010 | Rowland et al. | 414/408 |

(Continued)

OTHER PUBLICATIONS

Internatonal Search Report and Written Opinion dated Apr. 9, 2013 for counterpart PCT application.

*Primary Examiner* — Kaitlin Joerger

(74) *Attorney, Agent, or Firm* — Brett D. Papendick; Shuttleworth & Ingersoll, PLC

(57) ABSTRACT

An adapter for front forks of a front loading commodity collection truck allows the truck to collect from rear load and side load style containers. An intermediate container is carried on the forks of the truck. An engagement apparatus is mounted on the intermediate container and is laterally extendible to engage the commercial container at curbside and draw the container to the intermediate container. The engagement apparatus will lift the commercial container and tip it over the intermediate container. Controls in the cab of the truck control operation of the adapter. The adapter can be removed easily from the forks when a front loading refuse container is encountered.

12 Claims, 7 Drawing Sheets

(56) References Cited

U.S. PATENT DOCUMENTS

2011/0188976 A1* 8/2011 Rowland et al. ..... 414/408
2012/0087773 A1* 4/2012 Curotto et al. ..... 414/810
2012/0273498 A1* 11/2012 Curotto ..... 220/495.06
2013/0243554 A1* 9/2013 Rowland et al. ..... 414/408

* cited by examiner

ADAPTER TO EMPTY REAR END LOAD OR SIDE LOAD REFUSE CONTAINERS INTO FORK BORNE INTERMEDIATE CONTAINER

CROSS REFERENCE TO RELATED APPLICATIONS

This application claims priority under 35 USC §119 from copending provisional patent application entitled ADAPTER TO EMPTY REAR END LOAD OR SIDE LOAD REFUSE CONTAINERS INTO FORK BORNE INTERMEDIATE CONTAINER, Ser. No. 61/591,633, filed Jan. 27, 2012, The disclosure of provisional patent application Ser. No. 61/591,633 is hereby incorporated in its entirety.

BACKGROUND

The present invention pertains to front loading commodity collection bodies equipped with front forks which can elevate a container holding waste commodities to an elevated position above a top load opening of the collection body.

Historically, commercial waste commodity containers have been available in three basic styles: front loading, in which the container is equipped with fork pockets on the opposing ends of the container so the container can be lifted to a position above the top load opening of the collection body; side loading containers in which the container is equipped with hooks on the front sidewall of the container which may be engaged with engaging catch apparatus on the side-loading collection body; and rear loading containers which are provided with a trunnion bar running along the top edge of the front sidewall of the container, such that the trunnion bar may be engaged with trunnion pockets mounted to the outer wall of a trough carried at the rear of the rear loading collection body such that the rear loading container can be rotated about its trunnion bar and emptied into the rear trough of the collection body.

Because of these three distinctive and mutually exclusive types of containers, it is common for commodity haulers in the refuse and recycling industry to use a specific commodity collection truck equipped with a specific commodity collection body to collect the corresponding front loading, side loading or rear loading containers, with each collection body being capable of collecting from only one of the types of commercial containers. Each different style of specific orientation of commercial container has a specific and differently designed attachment apparatus that corresponds to the specific style of truck, so in order to collect all three of the different types of commercial containers the hauler would need to have three kinds of commodity collection trucks in the hauler's operation.

SUMMARY OF THE INVENTION

An adapter system for the front load forks of a standard front loading collection body mounted on a commodity collection truck is disclosed. This refuse collection body adapter system invention converts a standard commercial front loading truck into a truck that can collect each style of front load, side load and rear load commercial refuse or recycling container. In addition to the versatility to collect the three types of commercial containers, the adapter system also offers the truck operator the safety and convenience to collect all front, side and rear load commercial container orientations with an automated collection method so the truck operator never has to leave the cab of the truck when collecting containers on route.

In addition to being capable of attaching to and emptying the three main styles of commercial refuse commodity container, the adapter is also equipped to grasp and upend a common type of household or small commercial waste container by use of gripping arms which wrap about the container and grasp it for retention to the adapter as the container is upended over an intermediate container which is part of the adapter system.

The adapter may mount on the front forks of a conventional front loading commodity collection truck and includes an intermediate container, a hit mechanism for lifting the refuse container and upending it over the intermediate container, and an engaging apparatus which will latch to either a rear load trunnion-equipped refuse container, a side load hook-equipped refuse container, or a residential container. The adapter may be easily removed so that the collection truck may be used to collect from front load refuse containers may use of the front forks of the truck as in conventional front loading trucks. Therefore, the adapter can convert a front loading collection truck into a collection truck which may be used to collect rear load and side load styles of commercial containers, along with residential or small commercial narrow upright refuse containers.

With the adapter system disclosed, changing between the side and rear load container orientations is as simple as sliding the disclosed side load specific adapter off the front load forks and replacing it with a rear load specific adapter which can be slid onto the front load forks in a matter of minutes. All front load commercial containers can be emptied into the collection body using the standard front load forks with the adapter system removed from the forks, and then the adapter system can be slid back onto the front forks for collection of waste commodity from rear load or side load commercial containers. Again, this means that a single commodity collection truck is able to perform the tasks of three different conventional individual refuse collection trucks For use of the front loading refuse collection trucks for collection from a front loading container encountered along a collection route, the truck operator may remove the adapter from the front forks by sliding the adapter off the forks. Then the truck can be used in the conventional manner with the forks of the truck engaging the fork pockets of the front loading container. After the front load container is lifted over the top load opening of the collection body, the container is lowered to ground level and the truck backs away to pull the forks from the fork pockets. Then the adapter may be remounted to the forks by insertion of the forks into fork pockets on the intermediate container of the adapter. A simple locking mechanism such as a chain may be used to secure the adapter to the forks while the hydraulics of the collection truck do the heavy work of mounting the adapter to the front forks. However proper orientation of the forks will make a locking mechanism unnecessary when the operator is skilled sufficiently not to over rotate the intermediate container over the top load opening of the collection body, to the point that the adapter might slide off the forks.

The adapter is available in two configurations, namely one provided with trunnion pockets to receive the trunnion bar of a standard rear load container, and another form of the adapter with the catches for the hooks mounted to the front sidewall of the typical side loading container. Either type of adapter may also be optionally equipped with gripping arms which may be operated to wrap around the body of a residential container when such a container is encountered.

When the truck operator expects to encounter side load containers as well as front load containers, a second embodiment of the invention adapter is slid onto the forks in place of the rear loading embodiment. The second embodiment includes an intermediate container carried on the forks and equipped with a container engagement system equipped with catches to interlock to the hooks on the side load containers. The lift mechanism of the adapter will be essentially the same for either embodiment of the adapter invention.

The invention provides various safety and economic benefits, namely:

- Because the commodity collection truck can be used to collect each of the three types of commercial containers using an automated method, the operator does not have to ever leave the comfort and safety of the truck cab while on the collection route. This is the safest means of refuse and recycling collection. This is particularly important with unloading of rear load containers where the driver of a rear load collection body must do all of the work from behind the truck and in the way of traffic.
- Route time can be greatly reduced by collecting front, side and rear load commercial containers using an automated means, versus having the operator get out of the truck cab, retrieve the commercial container, hook up the container to the loading mechanism, dump the container into the truck, unhook the container from the loading mechanism, take the container back to its original location and get back into the truck cab before proceeding to the next collection point.
- One front loading truck can collect ail three types of commercial containers, rather then needing three individual trucks to do the same work, leading to greatly reduced operating cost.
- If one adapter system breaks down, the truck itself does not have to be taken out of service, but rather the hauler would simply need to replace the broken adapter system with another working adapter system of the same type, reducing the amount of costly truck down time or need for multiple backup trucks.
- Since the front load truck has an adapter system attachment the intermediate container can also be used in waste collection on residential routes along with commercial routes. For example, residential refuse can be emptied manually by dumping refuse or recyclables directly into the intermediate container, or by a semi-automated means such as a cart tipper carried on the adapter system or by automated means such as a cart grabber carried on the adapter system.
- The adapter system allows the truck operator to see what is being dumped into the intermediate container (and eventually the truck itself) from the commercial container. This provides both safety and economic benefits, because the operator has the opportunity to see if there is any type of toxic, burning, flammable, or other type of hazardous material that comes from the commercial container while the commercial container is being dumped in the adapter system. This can all be viewed while in the comfort and safety of the truck cab. If the operator is collecting recyclables, the operator can make sure that the recycling material isn't contaminated with materials that are not desirable.

Therefore it is a primary object of the invention to provide an adapter to convert a front loading commodity collection truck into a collection truck which may collect trash or recyclables from any of the three major commercial styles of refuse commodity containers and from residential containers as well.

These and other objects of the invention will be understood from examination of the detailed description which follows.

BRIEF DESCRIPTION OF THE DRAWINGS

Identical parts among various embodiments are referenced with the same reference numeral throughout this description and the drawing figures.

DETAILED DESCRIPTION

Figure 1:
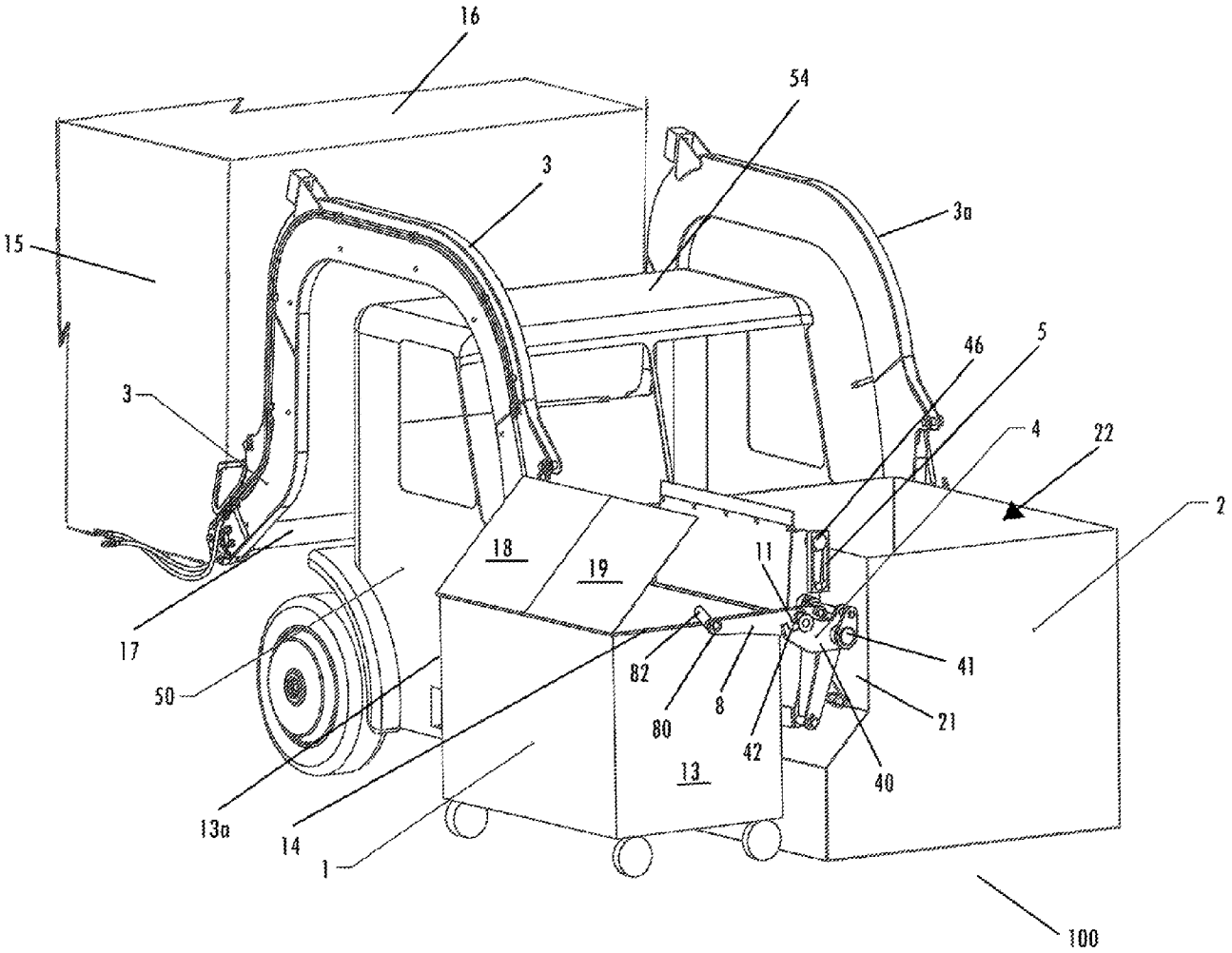
FIG. 1 is a front left perspective of a commodity collection truck with some parts truncated or omitted, the truck being equipped with a first embodiment of an adapter system according to the present invention, the adapter system carried on the front forks on the main lift arms of the truck, and including an intermediate container and a container engaging mechanism for engaging and upending a trunnion equipped rear end load style refuse container.

Definitions. The following definitions will apply throughout this disclosure:

"Refuse commodity" and "waste commodity" will mean materials which have been discarded and includes garbage, refuse, trash, and recyclable materials.

"Refuse collection body" and "commodity collection body" will mean a large container to receive waste commodities which is carried on a refuse collection truck.

"Front load collection truck" will mean a motor vehicle which carries a refuse collection body equipped with a pair of lift arms with movable forks on the ends of the lift arms, the forks positioned in front of the vehicle when ready to engage a front load container, with the forks adapted to enter fork pockets on the sides of a commercial front load container, with the arms capable of lifting the trout load container over the top of the cab of the vehicle and tipping the front load container over a top load opening of the refuse collection body to empty the contents of the front load container into the refuse collection body.

"Front load container" will mean a large commercial refuse container with hinged lid or lids which has horizontal fork pockets on opposing sides of the container.

"Rear load container" and "rear end load container" will mean a commercial refuse container which is designed to be tipped about a trunnion bar on the container into a trough carried at the rear of the refuse collection truck.

"Side load container" will mean a commercial refuse container having hook pockets on a front side thereof which will couple to a mechanism on a refuse collection truck which lifts the container from the side of the truck and tips the container to empty it into a top load opening of the refuse collection body on the refuse collection truck.

"Residential refuse container" and "upright refuse container" will mean a refuse container which is taller than it is wide.

Referring to FIGS. 1-7, apparatus for collection of refuse commodities comprises a truck 50 with a chassis 17 having a commodity collection body 15 mounted thereon, the truck 50 further comprising a cab 54. The commodity collection body 15 includes a pair of load arms 3, 3*a* pivotable thereon from a lowered position forward of the cab 54 of the truck 50 to an elevated position over the top load opening 16 of the commodity collection body 15. Each load arm 3, 3*a* has a fork 6 on the free end 20 thereof, the forks 6 being capable of selective orientation on the arms 3, 3*a*. Adapters 100, 120, 130, 140, 200 include an intermediate container 2 which is removably carried on the forks 6 of the commodity collection body 15. The intermediate container 2 includes opposing curbside sidewall 21 and street side sidewall 23, with each sidewall 21, 23 having a fork receiving lift pocket 7 mounted thereon. The fork receiving pockets 7 are oriented generally parallel with the bottom 24 of the intermediate container 2. The fork receiving pockets 7 easily receive the forks 6 when the forks 6 are in a generally horizontal orientation, the forks 6 being selectively rotatable about the free ends 20 of the arms 3, 3*a*. A container engaging mechanism 4, 104 is supported on the intermediate container 2. The adapters 100, 120, 130, 140, 200 include a hydraulic cylinder 12 or other driver attached to the engaging mechanism 4, 104 for elevating and tipping a commercial refuse container 1, 101 over the top load opening 22 of intermediate containers. The container engaging mechanism 4, 104 includes latch apparatus to selectively secure the commercial refuse container 1, 101 to the container engaging mechanism 4, 104. The commercial refuse container 1, 101 may be elevated by action of the hydraulic cylinder 12 to a location over a top opening 22 of the intermediate container 2 to empty contents of the commercial refuse container 1, 101 into the intermediate container 2. The intermediate container 2 may selectively be emptied into the top load opening 16 of the commodity collection body 15 as the lift arras 3, 3*a* are raised and the forks 6 are rotated to rotate the intermediate container 2 into an upended position. Control apparatus to operate the engaging mechanism 4, 104 and to raise and upend the container 1 is preferably located in the cab 54 and is operable by the truck operator while the operator remains in the cab 54 of the truck 50. The control apparatus also is operable to elevate the lift arms 3, 3*a* to raise the intermediate container 2 over the top lift opening 16 and to tip the intermediate container 2 when it is located above the top load opening 16. The control apparatus may be electro-hydraulic, controlling supply of pressurized hydraulic fluid to selective drive elements of the invention and the body 15 and truck 50.

Figure 2:
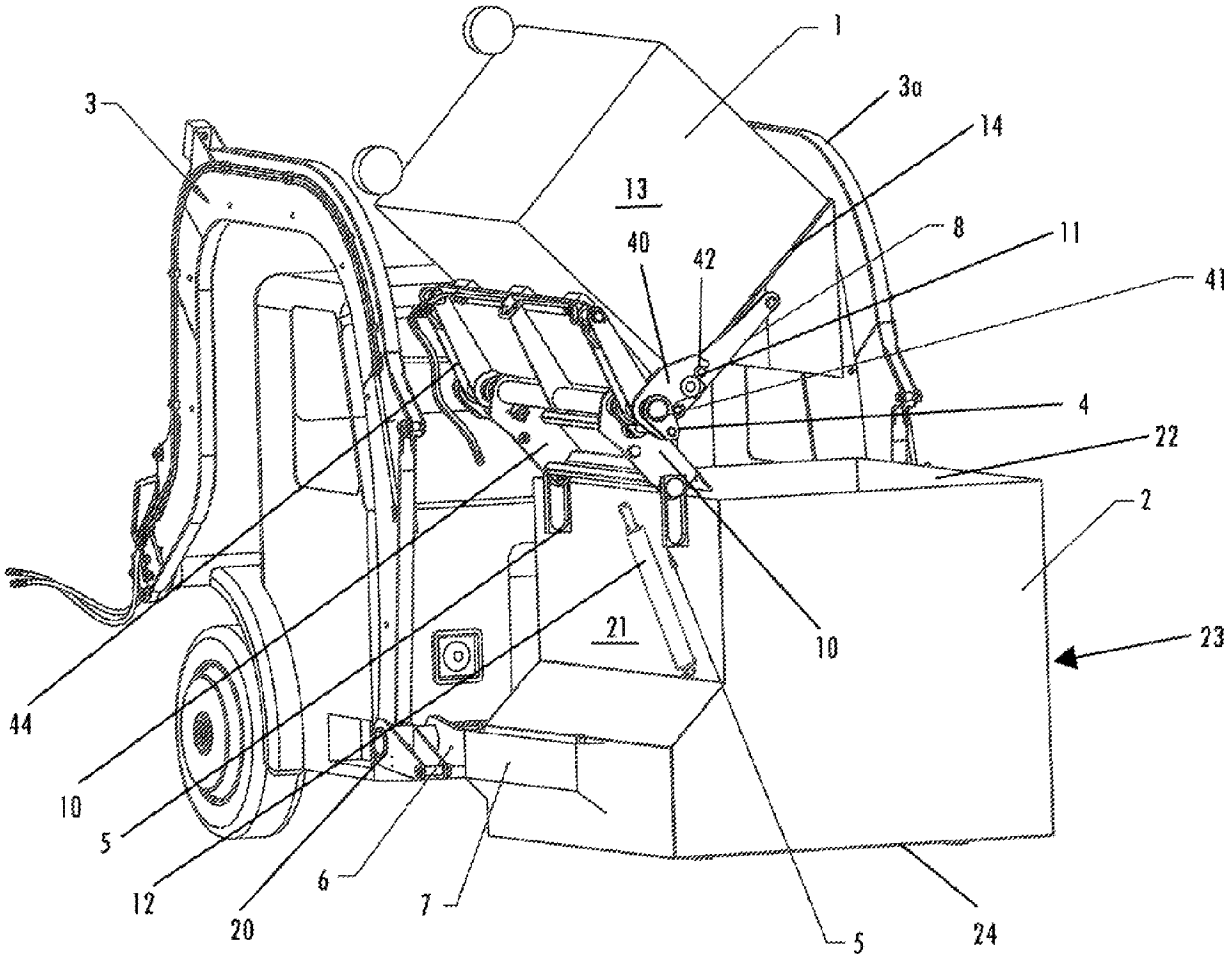
FIG. 2 is a front left perspective of the commodity collection truck of FIG. 1, with additional parts omitted or truncated, with the container engaging mechanism of the adapter system being engaged with and having upended the trunnion equipped refuse container over the intermediate container.

Specifically, FIGS. 1-2 show a rear end loading refuse container 1 coupled temporarily to the engagement mechanism 4 mounted to the intermediate container 2 at the curb side sidewall 21 thereof. The container engagement mechanism 4 is shown in the lowered position in FIG. 1. Intermediate container 2 is removably carried on front forks 6 of the front loading refuse truck 50 such that intermediate container 2 can be raised by arms 3, 3*a* and tipped over load opening 16 in the top of the collection body 15 carried on the front loading refuse truck 50. The operation of such a front loading refuse truck 50 is well known, the forks 6 usually being free to enter fork pockets 7 on opposing sides of a front loadable refuse container (not shown). The intermediate container 2 is equipped with fork lift pockets 7 on both curb side sidewall 21 and street side sidewall 23 thereof.

The engagement mechanism 4 includes a frame 10 on which a spaced apart pair of pocket arms 40 are supported. The pocket arms 40 are spaced apart a distance slightly in excess of the width of the commercial refuse container 1 between opposing end walls 13, 13*a* thereof. Each pocket arm 40 includes an open topped trunnion pocket 42 thereon which may receive ends of the trunnion bar 11 of container 1 which extend from each opposing end wall 13, 13*a* of refuse container 1. Engagement mechanism 4 also includes spaced apart retention arms 8 at each opposing end thereof which may urge refuse container 1 against stabilizer 44 of engagement mechanism 4 when container 1 is upended. Retention arms 8 are rotatable from an open generally upright position wherein a large gap exists between the top edge 14 of each end wall 13, 13*a* of refuse container 1, to a lock position where transverse bars 82 closely overlie or touch the top edges 14 of end walls 13, 13*a* of refuse container 1.

The bar 82 of each retention arm 8 is cantilevered from the retention arm 8 at or near the free end 80 of the retention arm 8. Each bar 82 extends generally toward the opposing bar 82 such that the bars 82 overlie the top edges 14 to selectively stabilize the refuse container 1 against the stabilizer 44 and to restrain the refuse container 1 from falling into the intermediate container 2 when tipped thereover.

Each bar 82 is inclined upwardly from its mounting on retention arm 8 when viewed in its lock position and with the engagement apparatus 4 in its lower position such as when attached or ready to be attached to a refuse container 1 in its upright orientation as illustrated in FIG. 1.

In FIG. 1, the lids 18, 19 of commercial refuse container 1 are shown in a raised, open position for exposition purposes only as they would not rest in this open position. Lids 18, 19, have no holding device and will rest on the top edges 14 of the container 1 by gravity, though they will swing open upon substantial tipping of the container 1 as with its upending for emptying. Because lids 18, 19 are typically fabricated of plastic and are therefore somewhat flexible, the lids 18, 19 will flex as they encounter bars 82 and because of the cant of bars 82, lids 18, 19 will deflect sufficiently so that they will fall open past bars 82 while bars 82 abut top edge 14 of container 1 to prevent container 1 from felling into the load opening 22 of intermediate container 2. Because lids 18, 19 may fall open past bars 82 as the rear end load container 1 is tipped, the rear end load container 1 can be emptied totally automatically without operator intervention.

Container engagement assembly 4 is attached to curb side sidewall 21 of intermediate container 2 by vertical tracks 5 mounted to curb side sidewall 21 along which bearing members 46 (bearings or rollers) may move as the engagement mechanism 4 is raised along curb side sidewall 21 of intermediate container 2. Elevation of engagement mechanism 4 is accomplished by drive members such as hydraulic cylinder 12 illustrated in FIG. 2.

Engagement assembly 4 also includes a guide member 48 which extends above support assembly 4 and may be substantially coplanar therewith, the guide member 48 preventing commodity dropping from refuse container 1 from dropping outside intermediate container 2 when the refuse container 2 is upended.

Pocket arms 40 are rotatable about the axis of axle 41 so that pocket arms 40 may reach under trunnion bar 11 and rise to catch trunnion bar 11 in the trunnion pocket 42 on each pocket arm 40. Then retention arms 8 are lowered so bars 82 closely overlie or touch top edges 14 of refuse container end walls 13, 13*a*.

Once raised sufficiently, refuse container 1 is rotated about bearing axles 46, the engagement assembly 4 being selectively driven by lift cylinder 12 to invert refuse container 1 over the top opening 22 of intermediate container 2.

Figure 3:
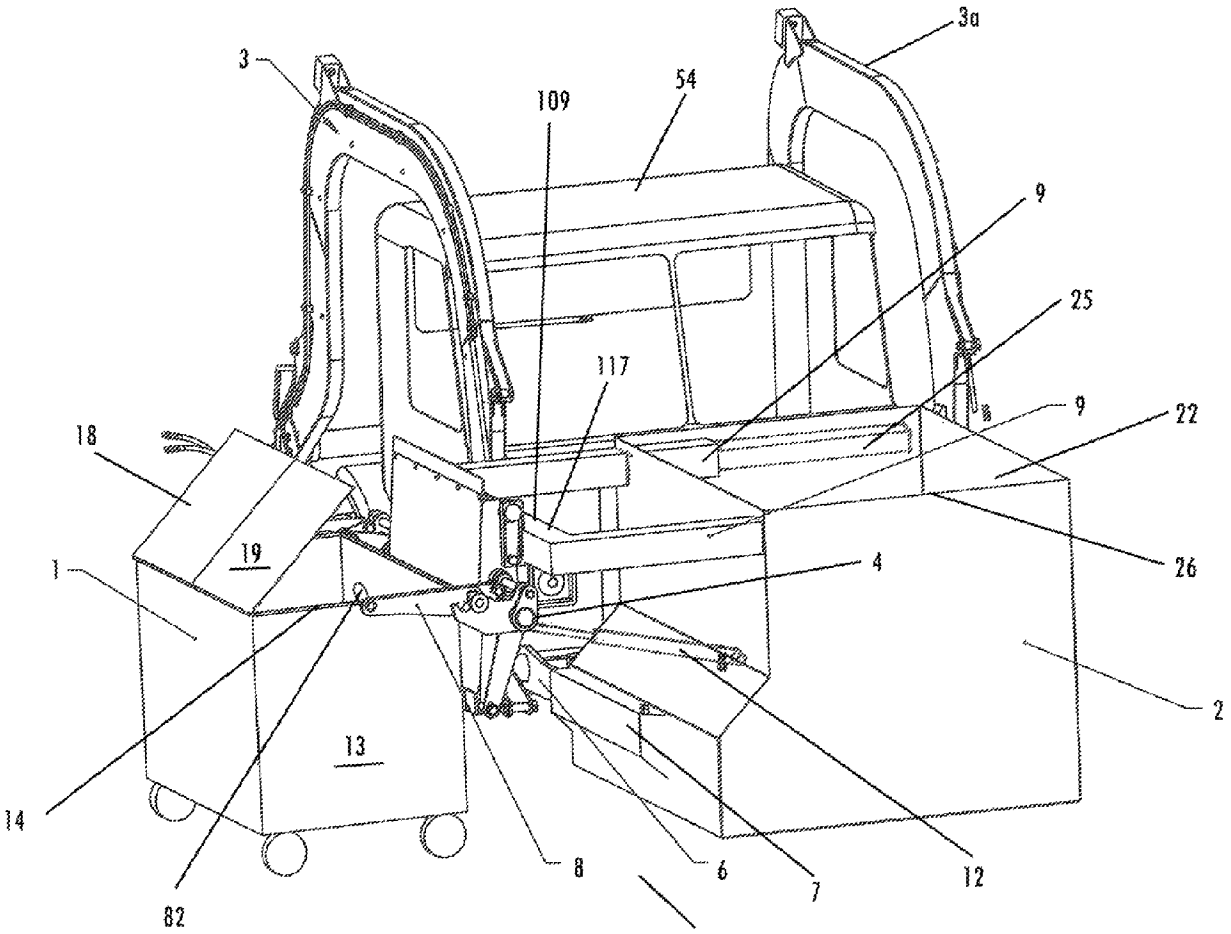
FIG. 3 is a front left perspective of an alternative embodiment of the adapter system of the commodity collection truck of FIG. 1 with the container engagement mechanism of the adapter system extended laterally from the intermediate container in order to retrieve a trunnion equipped refuse container from curbside of the intermediate container in advance of drawing the trunnion equipped refuse container alongside the intermediate container and lifting it to empty the contents thereof into a top opening of the intermediate container.

FIG. 3 illustrates a second embodiment adapter 130 wherein engagement assembly 4 is carried on extender frame 109 which include extender tubes 9 joined by cross beam 117. Extender tubes 9 engage and selectively slide along ride on rails 25 to selectively extend support mechanism 4 linearly and laterally from curb side sidewall 21 of intermediate container 2 near the top 26 thereof. Intermediate container 2 is removably carried on forks 6 inserted into fork lift pockets 7. Extender tubes 9 are extendible from a retracted position within intermediate container 2 to an extended position as seen in FIG. 3. Rails 25 are supported respectively on the interiors of the front wall and rear wall of intermediate container 2. It should be understood that extender tubes 9 may extend to any point between fall extension and the retracted position. Vertical tracks 5 are mounted to cross beam 117. Extender frame 109 carries engagement assembly 4 toward a refuse container 1 spaced laterally away from intermediate container 2 and allows engagement mechanism 4 to acquire refuse container 1 such that extender frame 109 may draw the container 1 alongside intermediate container 2 so that refuse container 1 can be lifted and tipped to empty its contents into intermediate container 2. Because of the cant of bars 82, lids 18, 19 need not be manually moved to an open position but instead will fall open past canted bars 82 when refuse container 1 is tipped, while bars 82 will engage the top edges 14 of opposing end walls 13, 13*a* to restrain rotation of refuse container 1 thereby preventing refuse container 1 from overrotating or dropping into the intermediate container 2.

Figure 4:
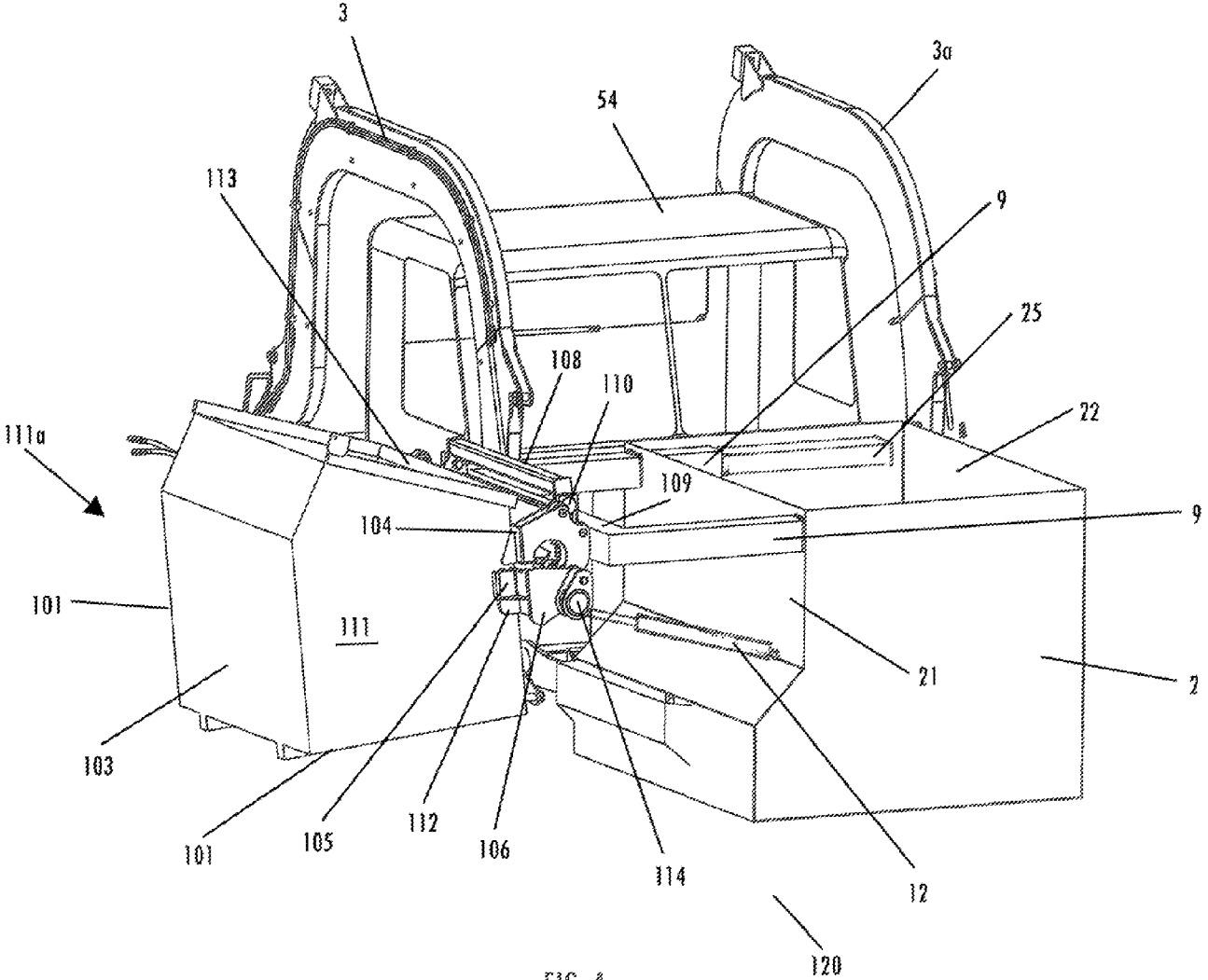
FIG. 4 is a front left perspective of a third embodiment of the adapter system adapted for retrieving a conventional side load container and unloading it into an intermediate container carried on the front lift forks of a conventional front end loading commodity collection body.
Figure 5:
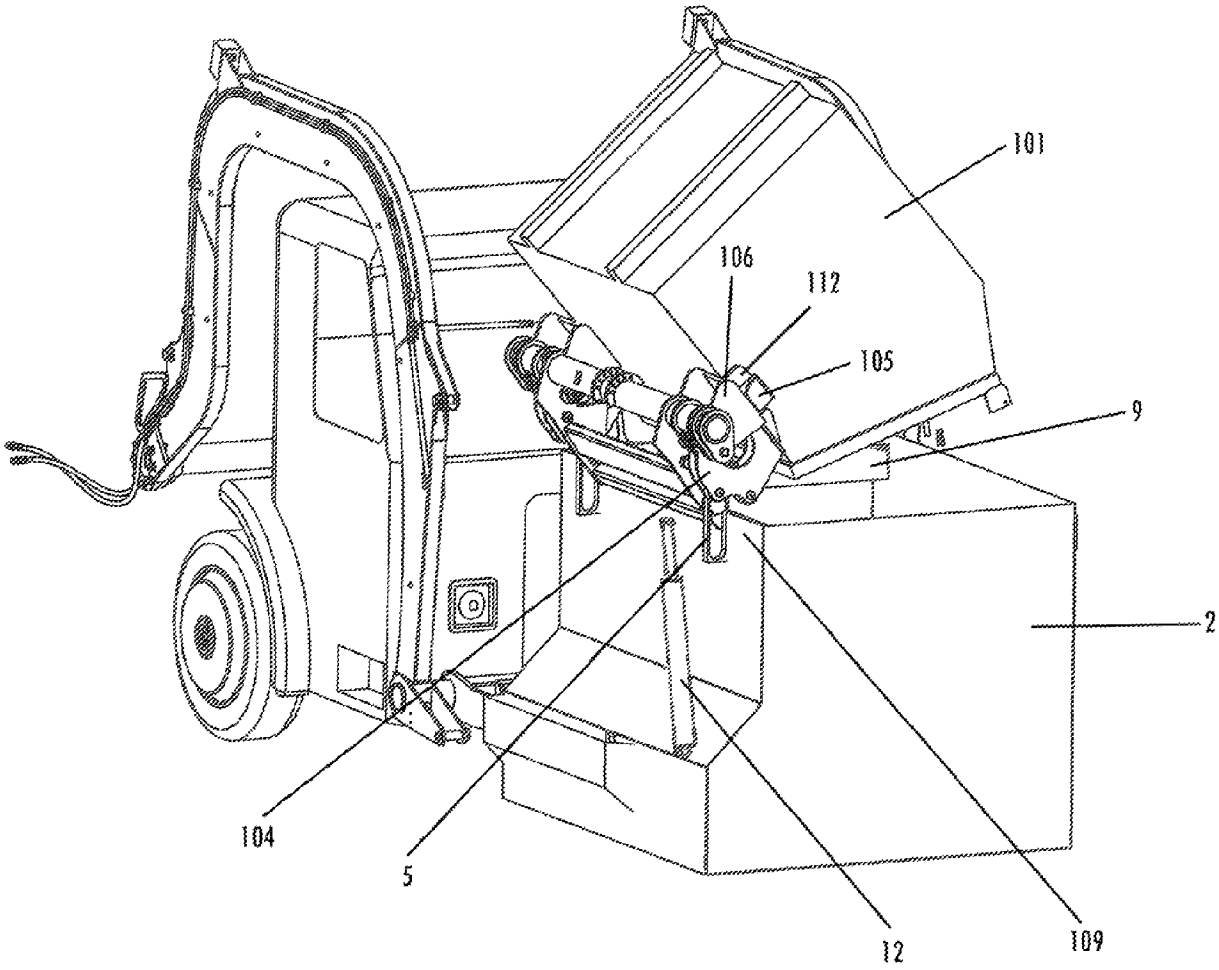
FIG. 5 is a front left perspective of the embodiment of FIG. 4 shown with the conventional side load container upended over the intermediate container and with some parts of the collection body truncated or omitted.

FIGS. 4 and 5 illustrate a typical side loading refuse bin 101 coupled to third embodiment adapter 120. Engagement mechanism 104 is carried on extender frame 109 and comprises hook frames 106 which support hooks 112 which couple to hook pockets 105 which are mounted to opposing ends 111, 111*a* of bin 101. A lock down bar 108 is selectively rotatable about axle 110 to clamp down on top edge 113 of bin 101 to trap bin 101 on hooks 112 carried on hook frame 106. Hook frame 106 is selectively rotatable about pivot 114 so that hooks 112 can reach under and rise into hook pockets 105. Driver elements (not shown) will operate lock down bar 108 and engagement mechanism 104 independently. Hydraulic cylinder 12 is also operated independently and all moving parts are controlled by controls in cab 54.

Once container 101 is securely attached to engagement mechanism 104, extension rails 9 are retracted and engagement mechanism 104 then is raised along lift tracks 5 and driven in rotation about axles 110 to cause bin 101 to empty its contents into top opening 22 of intermediate container 2.

Figure 6:
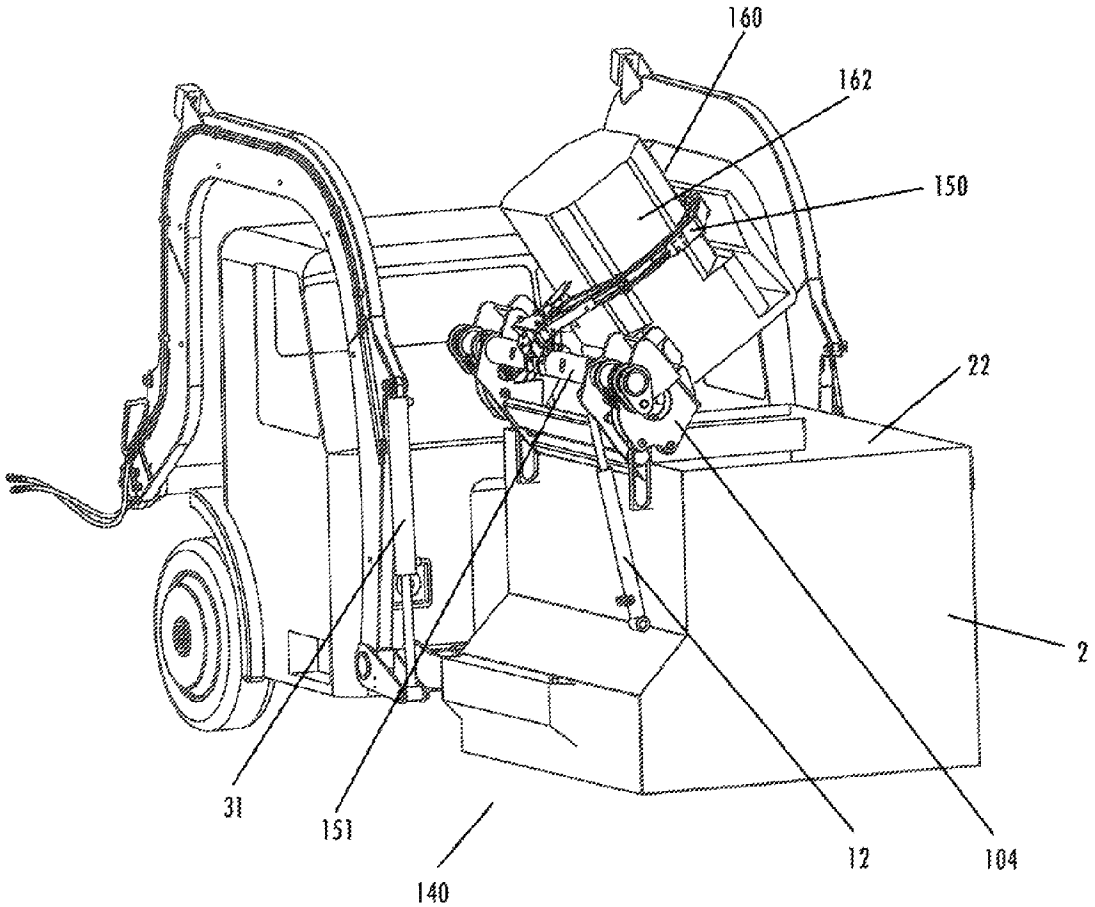
FIG. 6 is a front left perspective of an alternative embodiment of the adapter of FIG. 4 shown with the container engagement mechanism of the adapter system grasping a residential type refuse container with gripper arms thereof which selectively wrap around the refuse container, the refuse container being upended over the top load opening of the intermediate container.

FIG. 6 discloses a further alternative embodiment, namely adapter 140, for front load commodity collection truck 50. In this embodiment, gripper arm mechanism 150 is included on engagement mechanism 104 and is operable to move from a spread, rest position generally aligned with and parallel to beam 151 of engagement mechanism 104. Gripper arm mechanism 150 is independently operable to reach toward and surround the body 162 of a residential-type refuse container 160. After the refuse container 160 is secured by the gripper arms 150, the engagement mechanism 104 may be raised by lift cylinder 12 along track 5 and then upended over load opening 22 of intermediate container 2. It should be understood that gripper arm mechanism 150 may also be adapted for mounting to the engagement mechanism 4 illustrated in FIGS. 1-3.

Figure 7:
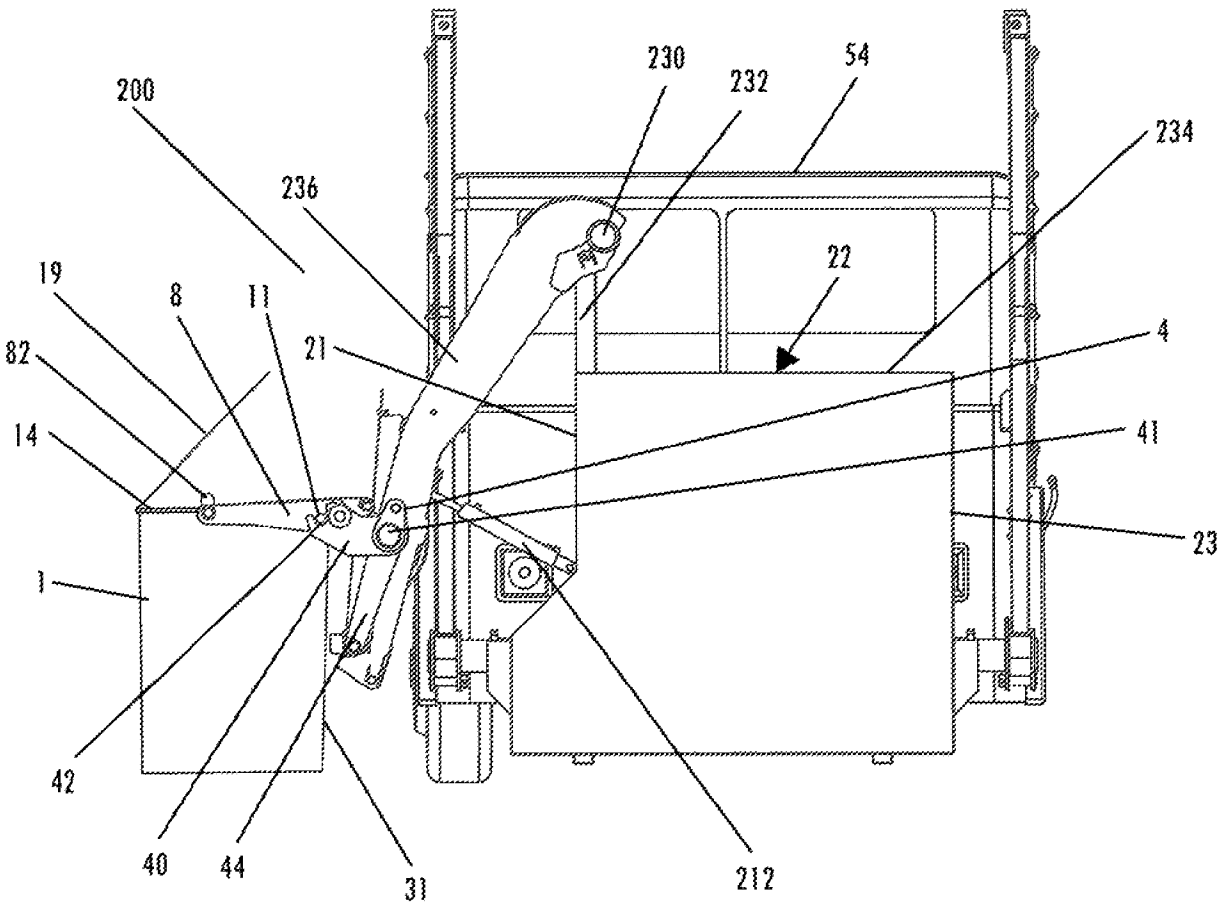
FIG. 7 is a front elevation of a fifth embodiment of the adapter system according to the present invention, the adapter system including a pivotable arm mounted to an intermediate container removably supported on the front forks of a conventional front end loading commodity collection body, the pivotable arm including a container engagement mechanism selectively engaging a trunnion equipped rear end load type refuse container.

FIG. 7 illustrates a further alternative embodiment of front load adapter 200 comprising the engagement mechanism 4 carried on an intermediate container 2 borne on front forks 6 of a traditional frontloading refuse truck 50. Engagement mechanism 4 is supported on at least one pivot arm 236 and has been extended away from the intermediate container 2 by rotation of pivot arm 236 about main pivot axle 230 which is supported on upright bars 232 which extend from the top 234 of intermediate container 2. Upright bars 232 are supported by intermediate container 2, preferably being welded to the inside of curb side sidewall 21 of container 2.

At least one but preferably a pair of pivot arms 236 are selectively rotatable about pivot axle 230 by drivers such as hydraulic cylinder 212. The hydraulic cylinder 212 may be selectively employed by operation of controls in cab 54. Engagement mechanism 4 is supported on pivot arms 236 and includes pocket arms 40 which are spaced apart slightly more than the length of rear loading container 1. Like with the adapter 100 shown in FIGS. 1-2, pocket arms 40 include trunnion pockets 42 which may receive ends of the trunnion bar 11 extending from opposing ends of the rear loading container 1 near the top of front wall 31 of the rear loading container 1. The pocket aims 40 are selectively rotatable about axles 41, which in the embodiment of FIG. 7 are supported on pivot arms 236, so that the pocket arms 40 can pass below the trunnion bar 11 and then rotate upward to catch the ends of trunnion bar 11 in the trunnion pocket 42 of each pocket arm 40.

Retention arms 8 as also seen in FIGS. 1-3, are moveable on engagement mechanism 4 from a raised position spaced substantially away from the top edge 14 of refuse container 1 to a closed position wherein bars 82 of arms 8 overlie the top edges 14 of refuse container 1. Bars 82 which extend at a small incline from retention arms 8, extend inwardly toward each other. As engagement mechanism 4 begins to rotate refuse container 1 about axles 41, the front sidewall 31 of refuse container 1 rests against stabilizer 44 as the truck operator begins the emptying operation of refuse container 1 into the top opening 22 of intermediate container 2.

Pivot arms 236 may swing out toward rear end load refuse container 1 when it is located curbside of the intermediate container 2, and engagement mechanism 4 may fasten to the refuse container 1 by positioning the trunnion bar 11 of the container 1 in the pockets 42 of pocket arms 40, whereupon the retention arms 8 may be lowered. The refuse container 1 may then be pulled toward intermediate container 2 and then drawn alongside curb side sidewall 21 of intermediate container 2. When the rear loading container 1 is alongside the intermediate container 2, the drive cylinder 212 may lift and rotate the engagement mechanism 4 with rear loading container 1 attached, into a substantially tipped, upended position over the top opening 22 of intermediate container 2. After the contents of refuse container 1 have dropped into intermediate container 2, the refuse container 1 may be returned to ground level and the pivot arras 236 may move it away from intermediate container 2. The adapter 200 can then release the rear loading container 1 from the engagement mechanism 4 at a location spaced away from the forks 6 so that the truck 50 may proceed along the street without the rear loading container providing any obstacles in the roadway.

It should be understood that a side load container support mechanism 104 as seen in FIGS. 4-6 may be substituted for the rear end load container engagement mechanism 4 supported on pivot arms 236 in FIG. 7. With such substitution, a side load commercial container 101 could be emptied into intermediate container 2 in the same way as is explained above for rear end load container 1.

When intermediate container 2 is sufficiently filled, it may be raised on the forks 6 by lift arms 3, 3*a* and moved over the cab 54 and inverted by operation of fork cylinders 31 (See FIG. 6) over the top load opening 16 (See FIG. 1) of the commodity collection body 15 carried on the truck 50.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising".

What is claimed is:

1. In an apparatus for collection of refuse commodities having a truck chassis with a commodity collection body mounted thereon, the truck chassis further supporting a cab for housing an operator, the commodity collection body including a pair of lift arms pivotable thereon from a lowered position forward of the cab of the truck chassis to an elevated position over a top load opening of the commodity collection body, the lift arms having forks on the free ends of the lift arms, and fork cylinders coupling the forks to the lift arms to selectively orient the forks on the lift arms, an adapter apparatus comprising:

an intermediate container selectively carried on the forks of the commodity collection body, the intermediate container including opposing sidewalls, each sidewall of the opposing sidewalls having a fork receiving pocket thereon, the fork receiving pockets generally parallel with a bottom of the intermediate container, the fork receiving pockets oriented to receive the forks when the forks are in a generally horizontal orientation, a container engaging mechanism supported on the intermediate container, the container engaging mechanism adapted to removably attach to a commercial refuse container, the container engaging mechanism moveable from a lowered position to a tipped position wherein the commercial refuse container attached to the container engaging mechanism is substantially tipped over a top opening of the intermediate container, control apparatus to operate the engaging mechanism, and to raise and tip the engaging mechanism, the control apparatus coupled to controls in the cab of the truck chassis, wherein the commercial refuse container may be elevated and tipped over the top opening of the intermediate container to empty contents of the commercial refuse container into the intermediate container and wherein the intermediate container may selectively be emptied into the top load opening of the commodity collection body, an extension frame is supported on the intermediate container, the extension frame including at least a first extension tube and a first rail, the at least a first rail mounted to a wall of the intermediate container, the wall being either a rear wall or a front wall of the intermediate container, the at least a first extension tube selectively slidable along the at least a first rail, the container engaging mechanism supported on the extension frame, the extension frame operable to laterally move the container engaging mechanism away from the intermediate container the extension frame comprises the at least a first rail and at least a first extension tube and a second rail and a second extension tube, one of the rails supported on the front wall of the intermediate container, the other of the rails supported on the rear wall of the intermediate container.

2. The adapter apparatus of claim 1 wherein the commercial refuse container includes a trunnion bar thereon, the trunnion bar disposed at a top of the commercial refuse container, the trunnion bar disposed at a top of the commercial refuse container, the trunnion bar extending from opposing end walls of the commercial refuse container, the container engaging mechanism includes a pair of spaced apart trunnion receiving pockets, the trunnion receiving pockets having open tops to receive opposing ends of the trunnion bar therein, the trunnion bar of the commercial refuse container selectively received in the trunnion receiving pockets, a pair of arms supported on the container engaging mechanism selectively operable between an open position and a lowered position, the arms when in the lowered position engaging opposing end walls of the commercial refuse container when the trunnion bar of the commercial refuse container is received in the trunnion pockets, the arms in the lowered position preventing the commercial refuse container from over rotating about the trunnion bar thereof when the commercial refuse container is upended over the top opening of the intermediate container.

3. The adapter apparatus of claim 2 wherein each of the arms further includes a transverse bar member extending therefrom, each of the transverse bar members overlying an opposing one of the tops of the opposing end walls of the commercial refuse container when the arms are in the lowered position.

4. The adapter apparatus of claim 3 wherein each of the transverse bar members inclines from the arm from which the transverse bar member extends when the arm is in the lowered position and the container engaging mechanism is in a lowered position.

5. The adapter apparatus of claim 4 wherein an extension frame is supported on the intermediate container, the extension frame including at least a first extension tube and a first rail, the at least a first rail mounted to a wall of the intermediate container, the wall being either a rear wall or a front wall of the intermediate container, the at least a first extension tube selectively slidable along the at least a first rail, the container engaging mechanism supported on the extension frame, the extension frame operable to laterally move the container engaging mechanism away from the intermediate container.

6. The adapter apparatus of claim 5 wherein the extension frame comprises the at least a first rail and at least a first extension tube and a second rail and a second extension tube, one of the rails supported on the front wall of the intermediate container, the other of the rails supported on the rear wall of the intermediate container.

7. The adapter apparatus of claim 1 wherein a pair of spaced apart vertical track elements are supported on the extension frame, the container engaging mechanism including bearing elements received in the track elements, the bearing elements of the container engaging mechanism moving along the vertical track elements as the refuse container is elevated while the extension frame is in a retracted position adjacent the curb side sidewall of the intermediate container, the container engaging mechanism rotating about an axis of the bearing elements as the container engaging mechanism is tipped over the top load opening of the intermediate container.

8. In an apparatus for collection of refuse commodities having a truck chassis with a commodity collection body mounted thereon, the truck chassis further supporting a cab for housing an operator, the commodity collection body including a pair of lift arms pivotable thereon from a lowered position forward of the cab of the truck chassis to an elevated position over a top load opening of the commodity collection body, the lift arms having forks on the free ends of the lift arms, and fork cylinders coupling the forks to the lift arms to selectively orient the forks on the lift arms, an adapter apparatus comprising:

an intermediate container selectively carried on the forks of the commodity collection body, the intermediate container including opposing sidewalls, each sidewall of the opposing sidewalls having a fork receiving pocket thereon, the fork receiving pockets generally parallel with a bottom of the intermediate container, the fork receiving pockets oriented to receive the forks when the forks are in a generally horizontal orientation, a container engaging mechanism supported on the intermediate container, the container engaging mechanism adapted to removably attach to a commercial refuse container, the container engaging mechanism moveable from a lowered position to a tipped position wherein the commercial refuse container attached to the container engaging mechanism is substantially tipped over a top opening of the intermediate container, control apparatus to operate the engaging mechanism, and to raise and tip the engaging mechanism, the control apparatus coupled to controls in the cab of the truck chassis, wherein the commercial refuse container may be elevated and tipped over the top opening of the intermediate container to empty contents of the commercial refuse container into the intermediate container and wherein the intermediate container may selectively be emptied into the top load opening of the commodity collection body, a pair of spaced apart vertical track elements are supported by a curbside sidewall of the intermediate container, the container engaging mechanism including bearing elements received in the track elements, the bearing elements of the container engaging mechanism moving along the vertical track elements as the refuse container is elevated, the container engaging mechanism rotating about an axis of the bearing elements as the engaging mechanism is tipped over the top load opening of the intermediate container.

9. In an apparatus for collection of refuse commodities having a truck chassis with a commodity collection body mounted thereon, the truck chassis further supporting a cab for housing an operator, the commodity collection body including a pair of lift arms pivotable thereon from a lowered position forward of the cab of the truck chassis to an elevated position over a top load opening of the commodity collection body, the lift arms having forks on the free ends of the lift arms, and fork cylinders coupling the forks to the lift arms to selectively orient the forks on the lift arms, an adapter apparatus comprising an intermediate container selectively carried on the forks of the commodity collection body, the intermediate container including opposing sidewalls, each sidewall of the opposing sidewalls having a fork receiving pocket thereon, the fork receiving pockets generally parallel with a bottom of the intermediate container, the fork receiving pockets oriented to receive the forks when the forks are in a generally horizontal orientation, a container engaging mechanism supported on the intermediate container, the container engaging mechanism adapted to removably attach to a commercial refuse container, the container engaging mechanism moveable from a lowered position to a tipped position wherein the commercial refuse container attached to the container engaging mechanism is substantially tipped over a top opening of the intermediate container, control apparatus to operate the engaging mechanism, and to raise and tip the engaging mechanism, the control apparatus coupled to controls in the cab of the truck chassis, wherein the commercial refuse container may be elevated and tipped over the top opening of the intermediate container to empty contents of the commercial refuse container into the intermediate container and wherein the intermediate container may selectively be emptied into the top load opening of the commodity collection body, the container engaging mechanism is supported on an extension frame, the extension frame comprising a pair of generally parallel spaced apart first elongated members, a cross beam joining the first elongated members, the container engaging mechanism supported on the cross beam, each elongate member selectively movable along a one of a pair of second elongate members, each of the second elongate members supported on the intermediate container, the extension frame movable between a retracted position wherein the cross beam is adjacent a first sidewall of the intermediate container and an extended position wherein the cross beam is spaced apart from the first sidewall of the intermediate container, the cross beam comprising a pair of spaced apart vertical track members supported on the cross beam, the container engaging mechanism further comprising generally coaxial bearing elements which ride along the vertical track members, wherein the container engaging mechanism selectively may be elevated along the track members and may be urged to rotate about the bearing elements to upend the engagement apparatus and a refuse container attached thereto.

10. Apparatus to unload a trunnion equipped refuse container into a front loading refuse collection body comprises an intermediate container selectively carried on front lift forks of the front loading refuse collection body, the intermediate container including a container engagement apparatus on a side thereof, the container engagement apparatus including spaced apart trunnion pockets into which ends of a trunnion bar extending from opposing ends of the refuse container are selectively receivable, the container engagement apparatus further comprising:

a stabilizer member for selective abutment to a front sidewall of the refuse container;

at least one moveable retention arm selectively abutting a top edge of the refuse container; and a drive member to rotate the refuse container about a pivot axle on the container engagement apparatus;

wherein the refuse container may be selectively attached to the container engagement apparatus and inverted over a top opening of the intermediate container, the container engagement apparatus supported on an extension frame, the extension frame including spaced apart generally parallel extension tubes, the extension tubes movable along rails supported on the intermediate container, the extension frame movable from a retracted position adjacent a first sidewall of the intermediate container to an extended position spaced apart from the first sidewall of the intermediate container.

11. The apparatus of claim 10 wherein each of the trunnion pockets is supported on an elongate pocket arm, each trunnion pocket having an open top for receiving an end of the trunnion bar of the refuse container, the pocket arms spaced apart at least a length of a front wall of the trunnion equipped refuse container, each pocket arm rotatable about a common axis.

12. The apparatus of claim 11 wherein each pocket arm is selectively rotatable to pass under one of the ends of the trunnion bar to capture the end of the trunnion bar in the trunnion pocket of the pocket arm, the at least one moveable retention arm is a first moveable retention arm associated with a first of the pocket arms, a second moveable retention arm associated with a second of the pocket arms, each of the retention arms moveable between an open position and a closed position, the open position of each retention arm spaced substantially away from the top edge of the refuse container, each retention arm having a transverse bar extending therefrom, each transverse bar inclined from horizontal when the retention arm is in its closed position and the refuse container is upright, each transverse bar directed toward the other transverse bar.

* * * * *